US009843860B2

(12) United States Patent
Li et al.

(10) Patent No.: US 9,843,860 B2
(45) Date of Patent: Dec. 12, 2017

(54) ELECTRONIC SYSTEM DENOISING DEVICE, WEARABLE DISPLAY DEVICE AND ELECTRONIC DEVICE

(71) Applicant: SHENZHEN ROYOLE TECHNOLOGIES CO. LTD., Shenzhen (CN)

(72) Inventors: Wei Li, Shenzhen (CN); Zihong Liu, Shenzhen (CN)

(73) Assignee: SHENZHEN ROYOLE TECHNOLOGIES CO. LTD., Nanshan, Shenzhen, Guangdong (CN)

( * ) Notice: Subject to any disclaimer, the term of this patent is extended or adjusted under 35 U.S.C. 154(b) by 105 days.

(21) Appl. No.: 15/057,886

(22) Filed: Mar. 1, 2016

(65) Prior Publication Data

US 2017/0018252 A1 Jan. 19, 2017

Related U.S. Application Data

(63) Continuation of application No. PCT/CN2015/083871, filed on Jul. 13, 2015.

(51) Int. Cl.
*H04R 3/00* (2006.01)
*H04R 5/033* (2006.01)

(52) U.S. Cl.
CPC ..... *H04R 3/00* (2013.01); *H04R 5/033* (2013.01); *H04R 2499/15* (2013.01)

(58) Field of Classification Search
CPC ..... H04R 2499/15; H04R 3/00; H04R 5/033
USPC ..... 455/572
See application file for complete search history.

(56) References Cited

U.S. PATENT DOCUMENTS

2004/0217749 A1* 11/2004 Orr ..... H02M 3/33569 323/299
2014/0268919 A1* 9/2014 Yao ..... H02M 3/33523 363/21.15
2015/0188442 A1* 7/2015 Kesterson ..... H02M 3/33523 363/21.15
2016/0006337 A1* 1/2016 Thalheim ..... H01F 27/2823 363/21.05

* cited by examiner

*Primary Examiner* — Tony Davis
(74) *Attorney, Agent, or Firm* — Morgan, Lewis & Bockius LLP

(57) ABSTRACT

An electronic system denoising device, includes: a power source, a first signal processing unit, a second signal processing unit and an isolating transformer. The power source is coupled to the first signal processing unit, and to the second signal processing unit via the isolating transformer, and supplies power to the first signal processing unit and the second signal processing unit. The first signal processing unit includes a first signal output end and a first grounded end, and the first signal output end outputs data signals to the second signal processing unit. The first grounded end is coupled to a first ground wire; the second signal processing unit includes a second grounded end coupled to a second ground wire. The electronic system denoising device, via the isolating transformer, avoids impact to the second signal processing unit from ground noise caused by the return current of the first signal processing unit.

13 Claims, 2 Drawing Sheets

ELECTRONIC SYSTEM DENOISING DEVICE, WEARABLE DISPLAY DEVICE AND ELECTRONIC DEVICE

RELATED APPLICATION

This application is a continuation application of PCT Patent Application No. PCT/CN2015/083871, entitled "ELECTRONIC SYSTEM DENOISING DEVICE, WEARABLE DISPLAY DEVICE AND ELECTRONIC DEVICE" filed on Jul. 13, 2015, which is incorporated by reference in its entirety

TECHNICAL FIELD

The present application relates to denoising technology for electronic systems, and more particularly relates to an electronic system denoising device, a wearable display device and an electronic device having the denoising device.

BACKGROUND

As the functions of electronic devices are more abundant, the electronic system for the electronic devices are becoming more complex. When a module of the electronic system produces signals leading to the ground level having noise, it will be prone to cause interference to analog small signals in the same system.

In view of that, the available technology provides a solution, which provides an independent power source to supply power to the modules which are prone to suffer interference, to realize isolation of the noise from the power source signals.

However, the above solution of the available technology needs to add more power sources, which increases the cost of the electronic device, on the other hand, also increases the weight of the electronic device.

SUMMARY

In order to solve the problems in the available technology, the present application provides a solution for noise caused by interference of ground level in a complex electronic system.

An embodiment of the present application provides an electronic system denoising device, including: a power source, a first signal processing unit, a second signal processing unit and an isolating transformer; wherein, the power source is coupled to the first signal processing unit, and the power source is coupled to the second signal processing unit via the isolating transformer, the power source supplies power to the first signal processing unit and the second signal processing unit;

the first signal processing unit comprises a first signal output end and a first grounded end, the first signal output end outputting data signals to the second signal processing unit, the first grounded end coupled to a first ground wire; and the second signal processing unit comprises a second grounded end coupled to a second ground wire.

The present application further provides a wearable display device, including a power source, a digital audio and video unit, an analog audio unit and an isolating transformer; wherein, the power source is coupled to the digital audio and video unit, and the power source is coupled to the analog audio unit via the isolating transformer, the power source supplies power to the digital audio and video unit and the analog audio unit;

the digital audio and video unit comprises an audio output end and a first grounded end, the audio output end outputting audio signals to the analog audio unit, and the first grounded end coupled to a first ground wire; and the analog audio unit comprises a second grounded end coupled to a second ground wire.

The present application further provides an electronic device, including the above electronic system denoising device.

The electronic system denoising device, the wearable display device and the electronic device having the electronic system denoising device of an embodiment of the present application, via the isolating transformer, avoid impact to the second signal processing unit from ground noise caused by return current of the first signal processing unit. Therefore the noise problem caused by interference of the ground level is resolved.

BRIEF DESCRIPTION OF THE DRAWINGS

The following figures is used for combination with embodiments to illustrate embodiments of the present application in detail. It should be understood that, components in the figures do not represent the actual size and the proportion relationship, they are only used for clearly illustrating the embodiments, and should not be understood as limitation to the present application.

DETAILED DESCRIPTION

Figure 1:
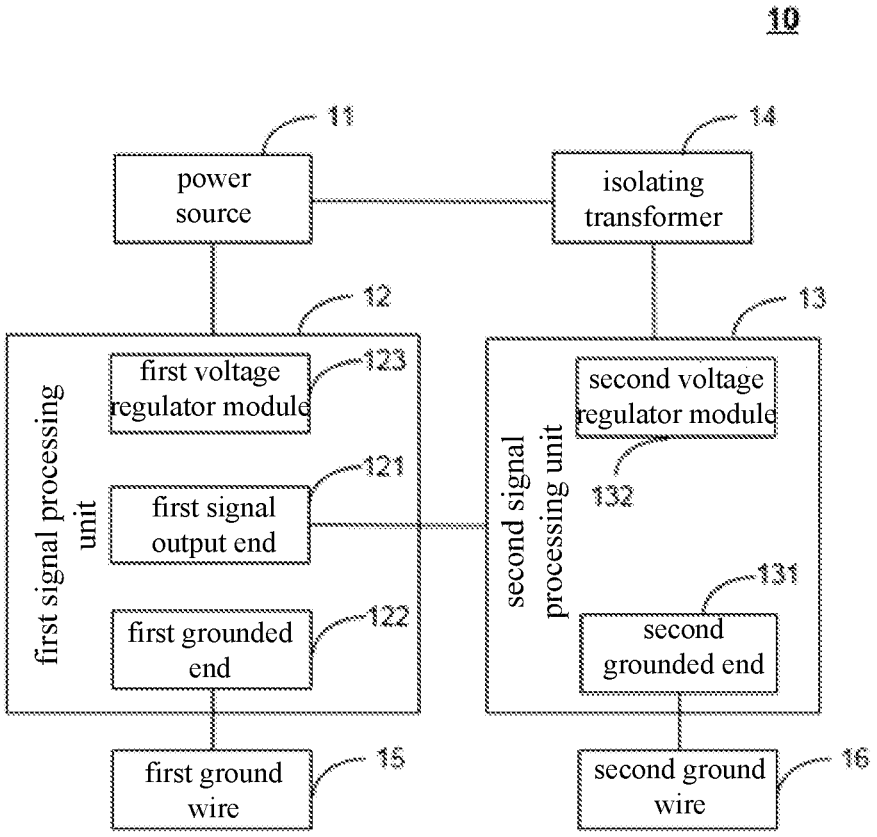
FIG. 1 shows a schematic structure of an electronic system denoising device in accordance with a first embodiment of the present application.

In order to more clear present application purpose, technology program and advantages of the present application, more details of the present application are further described in combination with the following embodiments and drawings. It should be understood that, the following described embodiments are only used for explaining, not limiting the present application. Furthermore, the elements showing in the drawings are only for illustration, rather than representing the actual proportional relation thereof.

In the description of the present application, the terms "first" and "second" are only used for description purpose, and should not be interpreted as instructions or suggests of the relative importance, or implying the number of the indicated technical characteristics. Thus, the characteristics having the "first" and "second" can express or imply to include one or more described characteristics. In the description of the invention, the meaning of "a plurality of" is two or more than two, unless being definitely expressed or specified in addition.

In the description of the invention, unless being definitely expressed or specified in addition, the terms of "connect" and "couple" each should have a general meaning. For example, "connect" and "couple" may mean electrical connection, mutual communication, direct connection, indirect connection via an intermedia, internal communication of two elements, or interaction of two elements. For the ordinary skilled person in the art, the specific meanings of the aforesaid terms of the present application can be comprehended according to the actual situation.

FIG. 1 shows a schematic structure of an electronic system denoising device of a first embodiment of the present application. As illustrated by FIG. 1, the electronic system denoising device 10 includes a power source 11, a first signal processing unit 12, a second signal processing unit 13 and an isolating transformer 14. The power source 11 is coupled to the first signal processing unit 12. The power source 11 is coupled to the second signal processing unit 13 via the isolating transformer 14. The power source 11 is configured to supply power to the first signal processing unit 12 and the second signal processing unit 13. The first signal processing unit 12 includes a first signal output end 121 and a first grounded end 122. The first signal output end 121 is configured to output data signals to the second signal processing unit 13, the first grounded end 122 is configured to be coupled to a first ground wire 15. The second signal processing unit 13 includes a second grounded end 131 configured to be coupled to a second ground wire 16.

Using the isolating transformer 14, the electronic system denoising device 10 of the embodiment of the present application physically separates isoelectric potentials of the first ground wire 15 and the second ground wire 16 respectively coupled to the first signal processing unit 12 and the second signal processing unit 13. Therefore, the current return paths of the first signal processing unit 12 and the second signal processing unit 13 are not overlapped, avoiding interference to the second signal processing unit 13 from ground noise caused by the return current of the first signal processing unit 12. Thus, the noise problem caused by interference of the ground level is effectively resolved under the same power source 11.

Preferably, the first signal processing unit 12 includes a first voltage regulator module 123, the second signal processing unit 13 includes a second voltage regulator module 132. An anode of the power source 11 is coupled to the first voltage regulator module 123, and is coupled to the second voltage regulator module 132 via the isolating transformer 14. Specifically, a primary winding of the isolating transformer 14 has a first end thereof coupled to the anode of the power source 11, and a second end thereof coupled to the first ground wire 15. A secondary winding has a first end thereof coupled to the second voltage regulator module 132, and a second end thereof coupled to the second ground wire 16.

Preferably, the first ground wire 15 and the second ground wire 16 are in a single point connection. For example, the first ground wire 15 are coupled to the second ground wire 16 by a 0Ω resistor. Due to the fact that a return circuit defined by the first signal processing unit 12 and the power source 11 is separated from a return circuit defined by the isolating transformer 14 and the second signal processing unit 13, the consistency of grounding potentials of the two ground circuits and integrality of two sets audio signals are realized. Signal distortion caused by different grounding potentials of the first ground wire 15 and the second ground wire 16 is thus prevented.

An electronic device of a second embodiment of the present application includes the electronic system denoising device of any implementation way of the illustrated embodiment.

Figure 2:
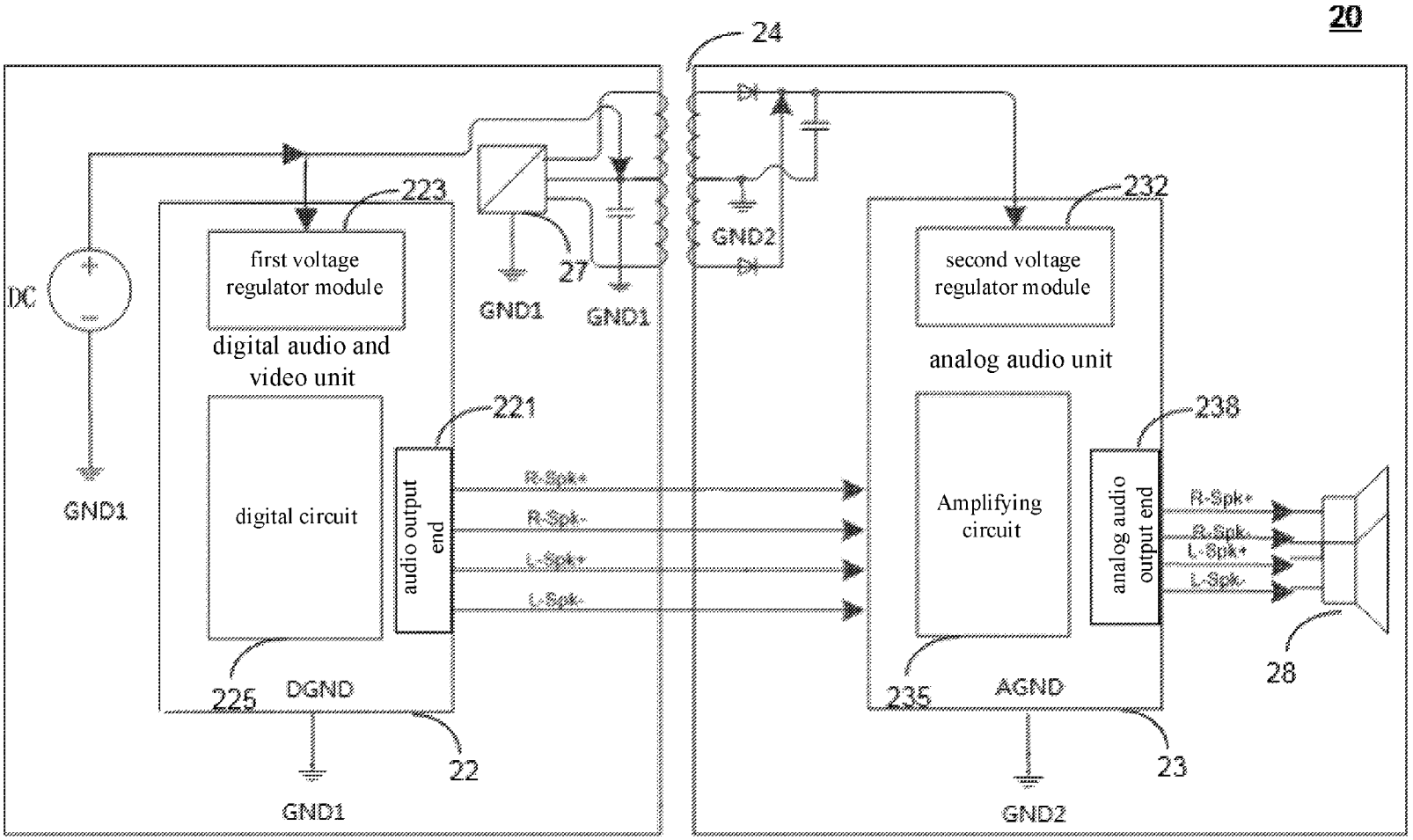
FIG. 2 shows a schematic structure of an electronic device in accordance with a second embodiment of the present application.

As an example, the electronic device can be a wearable display device. The wearable display device includes a display device (not shown) with display output, a headsets (not shown) with audio output, and the electronic system denoising device provided by the illustrated embodiment. In an embodiment, the display device includes a miniature display and an optical module, wherein the miniature display provides a display source, the optical module projects the display source to eyes of a user wearing the wearable display device, along a preset path, to provide near-to-eye display. The headsets is configured to provide audio output. Due to the display device and the headsets being available technical knowledge for the skilled person in the art, they are not given more descriptions here. Referring to FIG. 2, in this embodiment, an electronic system denoising device 20 includes a power source DC, a digital audio and video unit 22, an analog audio unit 23 and an isolating transformer 24. It can be understood that, the digital audio and video unit 22 in the illustrated embodiment is corresponding to the first signal processing unit 12, the analog audio unit 23 is corresponding to the second signal processing unit 13. The power source DC is coupled to the digital audio and video unit 22, and is coupled to the analog audio unit 23 via the isolating transformer 14. The power source DC is configured to supply power to the digital audio and video unit 22 and the analog audio unit 23. The digital audio and video unit 22 includes a first grounded end DGND, a first voltage regulator module 223 and an audio output end 221. The audio output end 221 includes a positive output terminal R-spk+ and a negative output terminal R-spk− of a right channel audio output, and a positive output terminal L-spk+ and a negative output terminal L-spk− of a left channel audio output. The first voltage regulator module 223 is coupled to an anode "+" of the power source DC, the audio output end 221 is configured to output audio signals to the analog audio unit 23, the first grounded end DGND is configured to be coupled to a first ground wire GND1, in this embodiment, the first ground wire GND1 is coupled to a cathode "−" of the power source DC. The analog audio unit 23 includes a second grounded end AGND coupled to a second ground wire GND2, a second voltage regulator module 232 coupled to the anode "+" of the power source DC via the isolating transformer 24.

The wearable display device further includes a speaker 28 coupled to an analog audio output end 238 of the analog audio unit 23. Specifically, the speaker 28 includes a left speaker 28 and a right speaker 28 respectively received in bodies of left and right earphones of the headsets. The analog audio output end 238 includes a positive output terminal R-spk+ and a negative output terminal R-spk− of a right channel audio output configured to output the right channel audio signals to the right speaker 28, and a positive output terminal L-spk+ and a negative output terminal L-spk− of a left channel audio output configured to output the left channel audio signals to the left speaker 28.

Specifically, the audio signals output by the audio output end 221 of the digital audio and video unit 22 may be analog audio signals separated and decoded by the digital circuit 225 according to digital and video audio signals. The analog audio unit 23, according to the analog audio signals, amplifies the signals by an amplifying circuit 235 and provides the signals to the speaker 28 to output the audio. Analogy video signals separated and decoded from the digital audio and video signals by a digital circuit 225 are output to the miniature display of the display device, and is provided to display the display source.

A first end of a primary winding of the isolating transformer 24 is coupled to the anode "+" of the power source DC, a second end of the primary winding of the isolating transformer 24 is coupled to the first ground wire GND1, a first end of a secondary winding is coupled to the second voltage regulator module 232, a second end of the secondary winding is coupled to the second ground wire GND2. In the illustrated embodiment, the power source DC is a direct current power source, the primary winding is further coupled to a DC/AC converter 27, the DC/AC converter is configured to convert the direct current to alternating current to be provided to the second winding to produce voltage.

The first ground wire and the second ground wire are in a single point connection. Specifically, the first ground wire GND1 is coupled to the second ground wire GND2 by a 0Ω resistor. Due to that a return circuit defined by the digital audio and video unit 22 and the power source DC is separated from a return circuit defined by the isolating transformer 24 and the analog audio unit 23, it is realized consistency of grounding potentials of the two ground circuits, and integrality of two sets audio signals, thereby preventing signal distortion because of different grounding potentials of the first ground wire GND1 and the second ground wire GND2

Using the isolating transformer 24, the wearable display device of the illustrated embodiment of the present application physically separates isoelectric potentials of the first ground wire GND1 and the second ground wire GND2 respectively coupled to the digital audio and video unit 22 and the analog audio unit 23. Therefore, current return paths of the digital audio and video unit 22 and the analog audio unit 23 are not overlapped, avoiding interference to the analog audio unit 23 from ground noise caused by return current of digital audio and video unit 22. The noise caused by interference of the ground level to the analog audio unit 23 is resolved.

The above descriptions are only preferred embodiments of the present application, not limiting the present application. Any modification, equivalent replacement and improvement, etc., within the spirits and principles of the present application, shall be included in the protective scope of the present application.

What is claimed is:

1. An electronic system denoising device, comprising:

a power source;

a first signal processing unit;

a second signal processing unit; and an isolating transformer;

wherein the power source is coupled to the first signal processing unit, and the power source is coupled to the second signal processing unit via the isolating transformer, the power source supplies power to the first signal processing unit and the second signal processing unit;

wherein the first signal processing unit comprises a first signal output end and a first grounded end, the first signal output end outputting data signals to the second signal processing unit, the first grounded end coupled to a first ground wire; and wherein the second signal processing unit comprises a second grounded end coupled to a second ground wire.

2. The electronic system denoising device as claimed in claim 1, wherein the first ground wire is coupled to a cathode of the power source.

3. The electronic system denoising device as claimed in claim 2, wherein the first signal processing unit comprises a first voltage regulator module coupled to the power source, and the second signal processing unit comprises a second voltage regulator module coupled to the isolating transformer.

4. The electronic system denoising device as claimed in claim 3, wherein a primary winding of the isolating transformer has a first end coupled to an anode of the power source and a second end coupled to the first ground wire; and a secondary winding of the isolating transformer has a first end coupled to the second voltage regulator module and a second end coupled to the second ground wire.

5. The electronic system denoising device as claimed in claim 1, wherein the first ground wire and the second ground wire are in a single point connection.

6. An electronic device, comprising the electronic system denoising device as claimed in claim 1.

7. A wearable display device, comprising:

a power source;

a digital audio and video unit;

an analog audio unit; and an isolating transformer;

wherein the power source is coupled to the digital audio and video unit, and the power source is coupled to the analog audio unit via the isolating transformer, the power source supplies power to the digital audio and video unit and the analog audio unit;

wherein the digital audio and video unit comprises an audio output end and a first grounded end, the audio output end outputting audio signals to the analog audio unit, and the first grounded end coupled to a first ground wire; and wherein the analog audio unit comprises a second grounded end coupled to a second ground wire.

8. The wearable display device as claimed in claim 7, wherein the first ground wire is coupled to a cathode of the power source.

9. The wearable display device as claimed in claim 8, wherein the digital audio and video unit comprises a first voltage regulator module coupled to the first voltage regulator module and the analog audio unit comprises a second voltage regulator module, the power source being coupled to the second voltage regulator module via the isolating transformer.

10. The wearable display device as claimed in claim 9, wherein a primary winding of the isolating transformer has a first end coupled to an anode of the power source and a second end coupled to the first ground wire, and a secondary winding of the isolating transformer has a first end coupled to the second voltage regulator module and a second end coupled to the second ground wire.

11. The wearable display device as claimed in claim 10, wherein the primary winding is further coupled to a DC/AC converter converting a direct current provided by the power source to an alternating current, the alternating current being provided to the second winding to produce voltage.

12. The wearable display device as claimed in claim 7 further comprising a speaker, wherein the analog audio unit further comprises an analog audio output end, and the speaker being coupled to the analog audio output end.

13. The wearable display device as claimed in claim 7, wherein the first ground wire and the second ground wire are in a single point connection.

* * * * *